US012357068B2

(12) United States Patent
Sullivan et al.

(10) Patent No.: US 12,357,068 B2
(45) Date of Patent: Jul. 15, 2025

(54) SLIM CONTACT LENS CASE

(71) Applicant: CONPACT, LLC, Potsdam, NY (US)

(72) Inventors: Quinn Sullivan, Canandaigua, NY (US); Anthony J. Beers, Central Square, NY (US)

(73) Assignee: CONPACT, LLC

( * ) Notice: Subject to any disclaimer, the term of this patent is extended or adjusted under 35 U.S.C. 154(b) by 0 days.

(21) Appl. No.: 18/455,985

(22) Filed: Aug. 25, 2023

(65) Prior Publication Data

US 2023/0404227 A1 Dec. 21, 2023

Related U.S. Application Data

(63) Continuation-in-part of application No. PCT/US2022/017656, filed on Feb. 24, 2022.

(60) Provisional application No. 63/153,708, filed on Feb. 25, 2021.

(51) Int. Cl.
*A45C 11/00* (2006.01)

(52) U.S. Cl.
CPC ..... *A45C 11/005* (2013.01)

(58) Field of Classification Search
CPC ..... A45C 11/005; A45C 11/046
USPC ..... 206/5.1; 134/901
See application file for complete search history.

(56) References Cited

U.S. PATENT DOCUMENTS 3,460,552 A * 8/1969 Sturgeon ..... A45C 11/005 134/143
5,383,550 A * 1/1995 Tsao ..... A45C 11/005 206/5.1
6,435,339 B1 * 8/2002 Kroupa ..... A45C 11/005 206/38
8,123,028 B2 * 2/2012 Doniga ..... A45C 11/005 116/272
2007/0034533 A1 2/2007 Coldrey et al.
2009/0211925 A1 8/2009 Doniga
2010/0122917 A1 * 5/2010 Azera ..... A45C 11/005 206/5.1
2016/0316873 A1 * 11/2016 Lynch ..... A45C 11/005
(Continued)

OTHER PUBLICATIONS

Rodriquez, Kari, "International Search Report and Written Opinion of the International Searching Authority", PCT International Application No. PCT/US2022/017656 filed on Feb. 24, 2022, mailed on Jun. 10, 2022, United States Patent and Trademark Office, Alexandria, VA (6 pages).

*Primary Examiner* — Steven A. Reynolds
(74) *Attorney, Agent, or Firm* — Woods Oviatt Gilman LLP; Dennis B. Danella, Esq.

(57) ABSTRACT

A contact lens case includes a body having a first upper surface, a bottom surface and a sidewall therebetween. The body defines a first recessed well configured to receive a first contact lens therein and a second recessed well configured to receive a second contact lens therein. A first cap is removably coupled with the body to selectively cover the first recessed well when in a closed position. The first cap includes a second upper surface such that the body is flush with the first cap when the first cap is in the closed position. A second cap is removably coupled with the body to selectively cover the second recessed well when in a closed position. The second cap includes a third upper surface such that the body is flush with the second cap when the second cap is in the closed position.

13 Claims, 14 Drawing Sheets

(56) References Cited

U.S. PATENT DOCUMENTS

2018/0116357 A1 5/2018 Fawcett et al.

* cited by examiner

SLIM CONTACT LENS CASE

CROSS-REFERENCE TO RELATED APPLICATIONS

This application is a continuation-in-part application of PCT Patent Application No. PCT/US2022/017656, filed Feb. 24, 2022, which, in turn, claims the benefit of U.S. Patent Application No. 63/153,708, filed Feb. 25, 2021, the contents of each of which are hereby incorporated in their entireties.

FIELD OF THE INVENTION

The present invention generally relates to a case for storing contact lenses, and more particularly to a slim contact lens case with a thin and compact form factor.

BACKGROUND OF THE INVENTION

A standard contact lens case typically features two caps that attach onto a case portion featuring two housing units for each contact lens. The caps often securely screw or snap onto the housing units to prevent solution from leaking out. However, existing contact lens cases are too bulky to be easily carried on your person. Contact lens wearers often forget or misplace their cases when traveling.

Thus, what is needed is a contact lens case with a thin and compact design, and that also makes storing and carrying contact lenses more convenient.

SUMMARY OF THE INVENTION

According to one aspect, a slim contact lens case is provided. The contact lens case comprises a body, a first lid and a second lid. The body includes a first upper surface, a first tray defining a first contact lens storage cavity, and a second tray defining a first contact lens storage cavity. Each of the first tray and the second tray are configured for receiving first and second contact lenses, respectively. The first lid is selectively coupled with the body in association with the first tray. The first lid includes a second upper surface, and is configured to retain the first contact lens in the first tray when the first lid is in a closed position. The first upper surface of the body is flush with the second upper surface of the first lid when the first lid is in the closed position. The second lid is selectively coupled with the body in association with the second tray. The second lid includes a third upper surface, and is configured to retain the second contact lens in the second tray when the second lid is in a closed position so that first upper surface of the body is flush with the third upper surface of the second lid when second first lid is in the closed position. In one example, the first upper surface and a lower surface of the body of the slim contact lens may be parallel to one another and be spaced apart between about 0.15 inches and about 0.35 inches.

In addition, the body may further include a first channel and a second channel defined therein, wherein the first channel and second channel are disposed around the first tray and the second tray, respectively. The first channel and second channel are configured to receive a first and second gasket, respectively, wherein the first and second gaskets are positioned to engage the respective first and second lids when the first and second lids are in their respective closed positions. Further, the lids may include a first connector adapted to selectively engage with a corresponding second connector defined in the body to maintain the lid in the closed position. Moreover, the body may have a through-hole defined in an outer edge of the body for receiving a keyring.

Other objects and advantages of the present invention will become apparent from the following description taken in connection with the accompanying drawings, wherein is set forth by way of illustration and example embodiments of this invention.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

The present invention is described below in enabling detail by the following examples, which may represent more than one example embodiment of the present invention.

Figure 1:
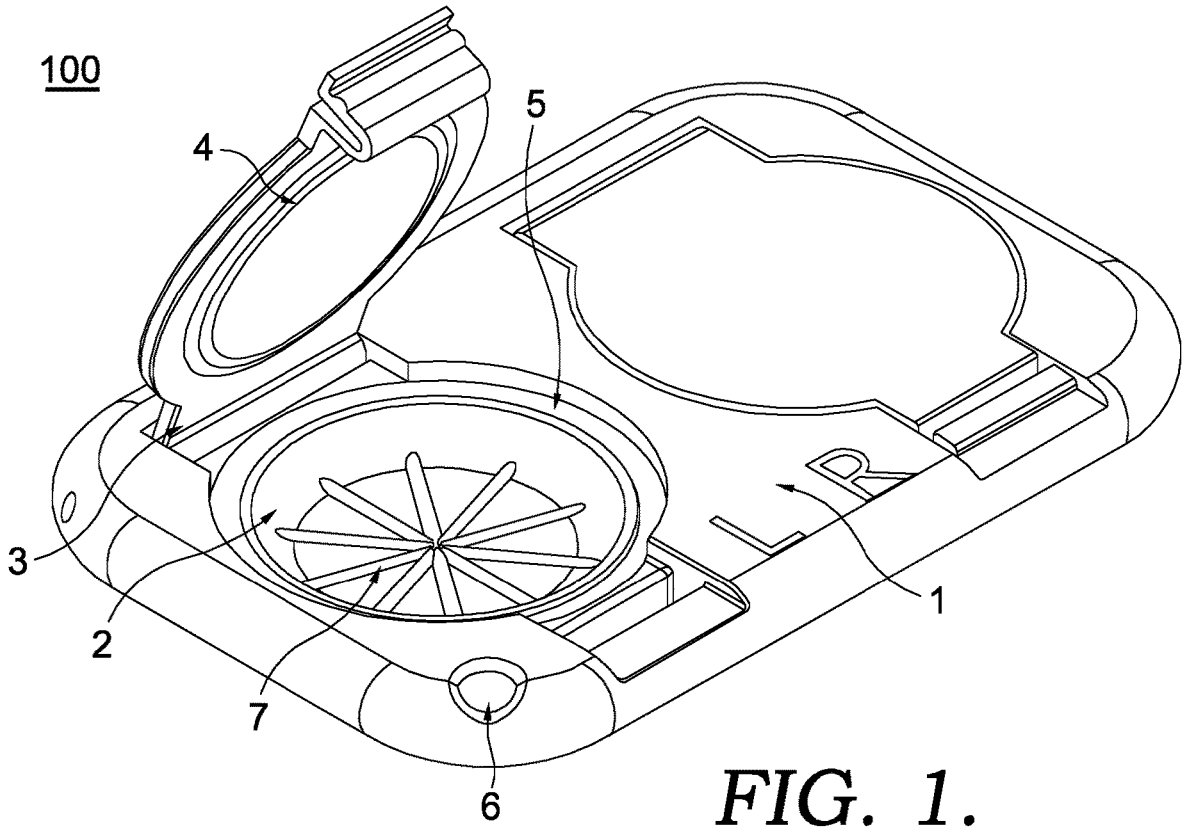
FIG. 1 is an isometric view of an example embodiment of a slim contact lens case, with a left lens compartment cover in an open position and a right lens compartment cover in a closed position.
Figure 2:
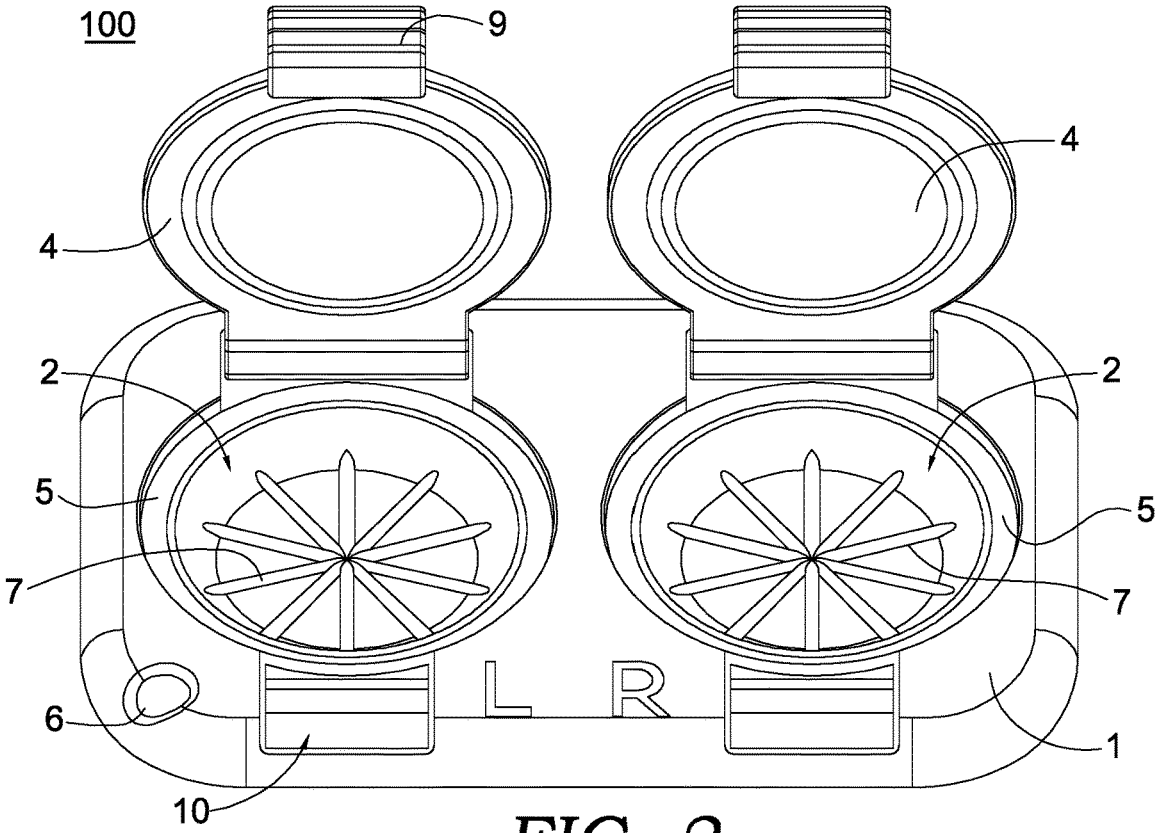
FIG. 2 is an isometric view of the contact lens case in FIG. 1 with both lens compartment covers in the open position.
Figure 3:
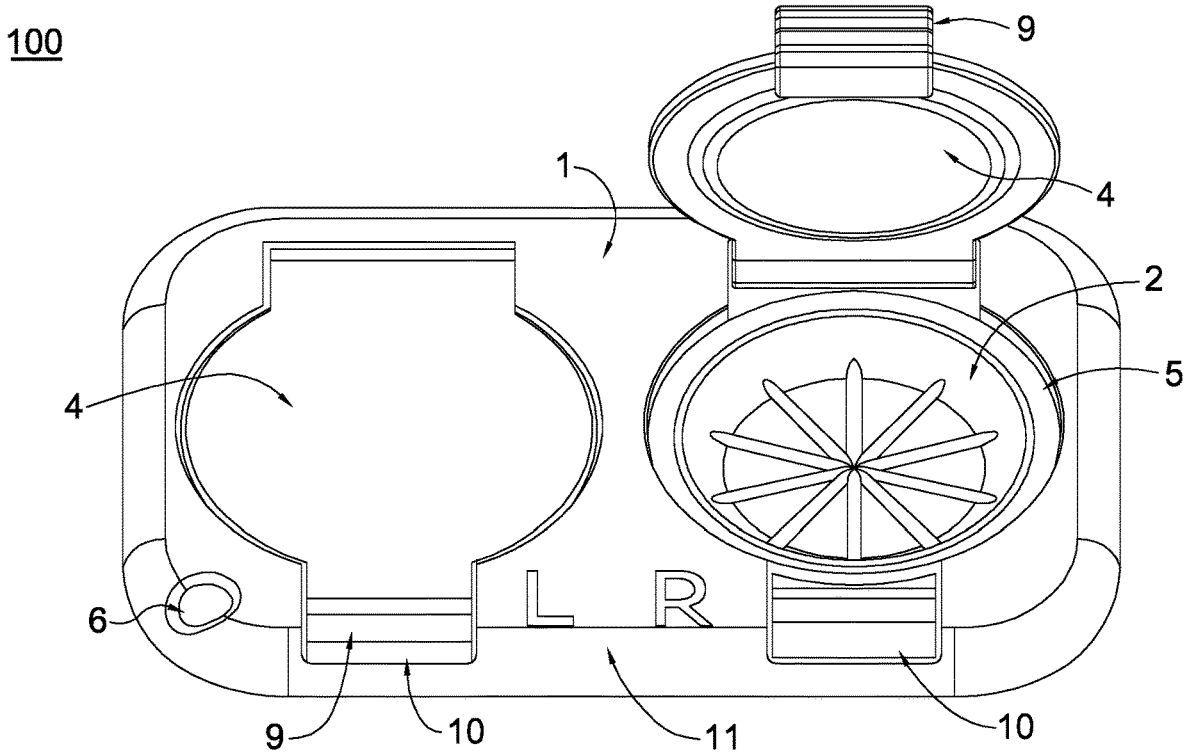
FIG. 3 is an isometric view of the contact lens case in FIG. 1 with the left lens compartment cover in the closed position and the right lens compartment cover in the open position.

Turning now to the drawings, with initial reference to FIG. 1, one exemplary embodiment of a slim contact lens case is provided and is identified with reference numeral 100. As shown in FIGS. 1, 2 and 3, slim contact lens case 100 includes a body 1 with two individual trays 2 defining respective cavities for contact lens storage within body 1. In general, body 1 can be made from a variety of materials, including plastics, rubbers, silicone, polymers, metals, or any other material(s) commonly used in the contact lens case industry. Each tray 2 has a respective lid 4 to selectively cover tray 2 in order to protect and retain the contact lens within each tray 2. One or more radially extending protrusions 7 may project from a bottom surface of tray 2 to prevent a contact lens from sticking to the bottom surface of tray 2, while allowing contact lens fluid to be positioned between the contact lens and the bottom surface. During use, each tray 2 can be filled with contact lens solution to clean and disinfect the inserted contact lenses when lid 4 is sealed, and the contact lens solution can be easily discarded from the cavities within body 1 for replacement with fresh solution.

Each lid 4 may be pivotally connected to body 1 by a hinge 3, which may be a hinge with an axle, an elastic hinge, a pin, or another suitable attachment means to open and close lid 4. For example, hinge 3 may be a single pin that extends through a bore 8 formed in body 1 and an aperture 3*a* (FIG. 6A) defined in each of lids 4, which operates to pivotally couple both lids 4 to body. Alternatively, for example, separate pins may be used to pivotally couple the lids 4 to body 1, wherein each pin is separately positioned within respective bores 8*a*, 8*b* and apertures formed in lids 4. Body 1 may also have a through-hole 6 defined therein that is configured for receiving a key chain ring, which will be described below with reference to FIG. 8. For instance, through-hole 6 may be disposed near an outer edge of body 1, such as near a corner. Body 1 has a relatively thin and compact form factor in comparison to standard contact lens cases, as mentioned above and discussed in further detail below.

With particular reference to FIGS. 1-5, each lid 4 further includes a latching mechanism that operates to selectively maintain lid 4 in a closed positioned relative to body 1. The latching mechanism may include a first connector 9 (such as a flexible clip, tab, snap, or other latch) that is positioned opposite hinge 3 and adapted to mate with a second connector 10 (such as a ridge, slot or other opening) defined in body 1 when closing lid 4. The first connector 9 and second connector 10 together provide the latching mechanism that securely maintains each lid 4 in the closed position to avoid accidental opening of lids 4 and/or prevent the contact lends solution from leaking out of tray 2. With additional reference to FIGS. 5, 6A and 6B, latching mechanism also maintains each lid 4 so that a top surface 14 of lid 4 is flush relative to a top surface 16 of body 1 to provide a slim profile as set forth in the present invention.

Figure 5:
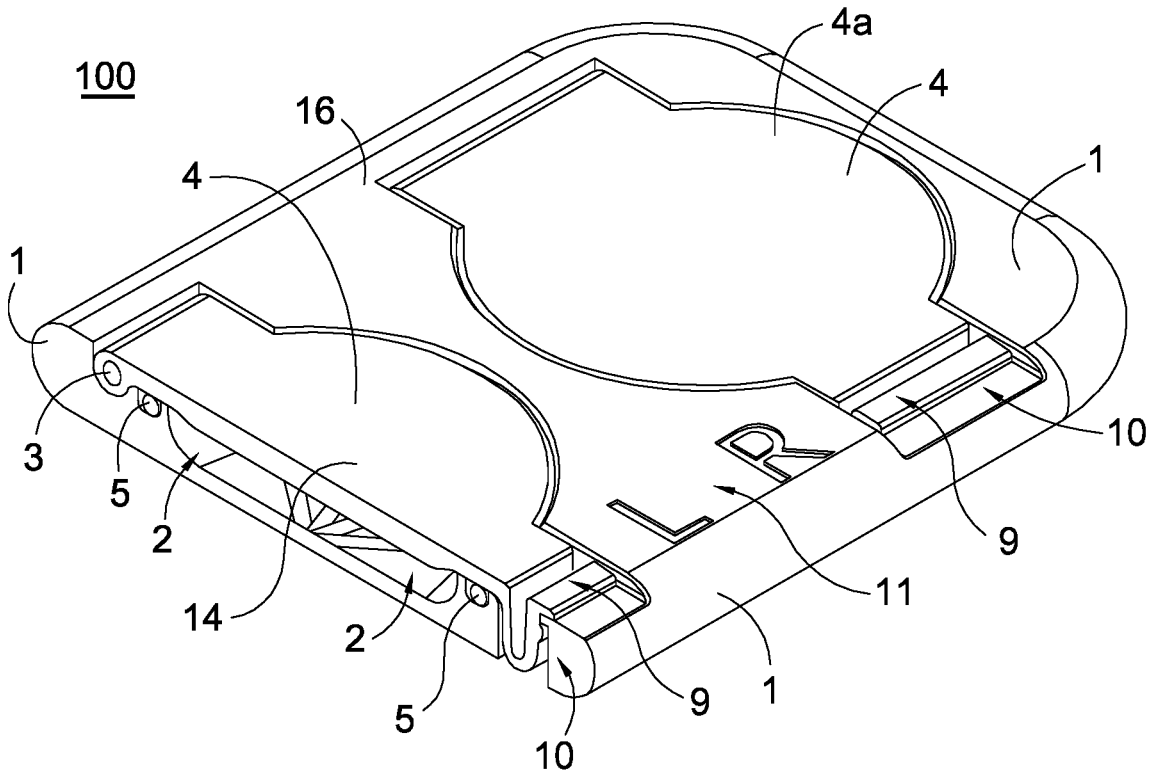
FIG. 5 is an isometric cross-sectional view taken along line 5-5 in FIG. 4 showing a hinge mechanism and a latch mechanism.
Figure 6A:
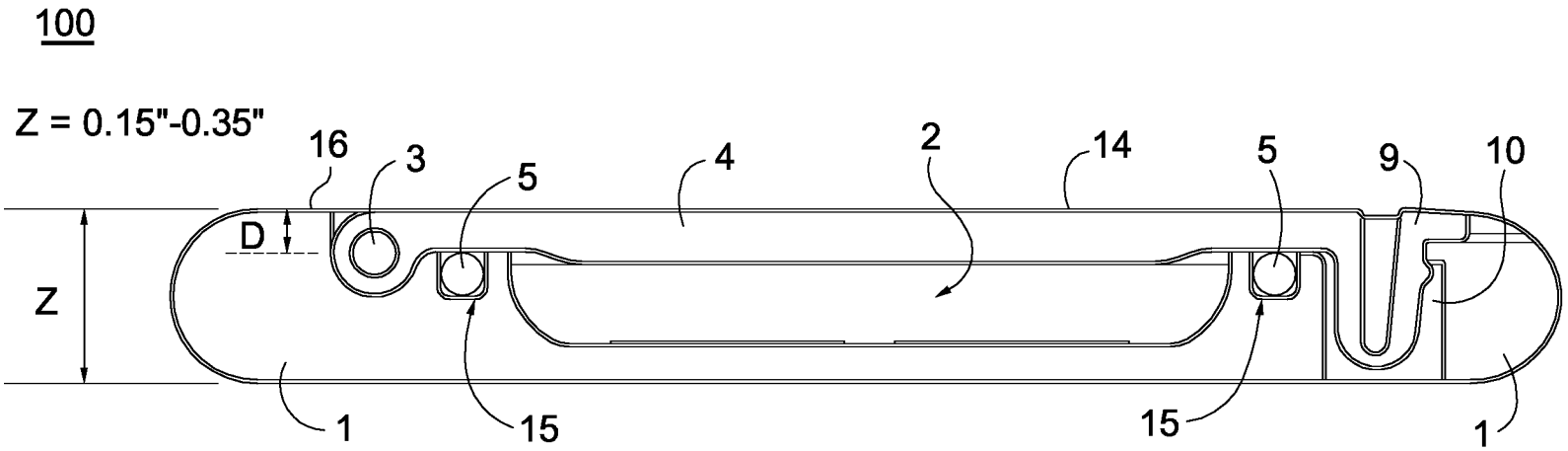
FIGS. 6A and 6B are left side elevational views of FIG. 5 where both of the lens compartment covers lie substantially flush with a body of the contact lens case in the closed position.

As shown in FIGS. 1-3, 5 and 6A, contact lens case 100 also includes a mechanism for preventing contact lens solution from leaking from tray 2. In particular, a cylindrical gasket 5 (e.g., an o-ring) may be disposed in a channel 15 defined in body 1 that surrounds a top edge of tray 2. As best seen in FIGS. 5 and 6A, gaskets 5 are disposed in channel 15 and are placed into contact or otherwise compressed when lid 4 is moved to the closed position to prevent the contact lens solution from flowing out of tray 2. Gaskets 5 may be formed of materials such as, but not limited to, plastics, rubbers, silicone, neoprene, polyurethane, polymers, metals, or other suitable materials for providing a tight seal under compression.

Channels 15 are recessed portions defined in the body 1 that surround each tray 2. In some example embodiments, channel 15 may have a circular or rectangular cross-section, or any other cross-sectional shape that is capable of retaining a gasket when seated in channel 15. Channels 15 may be integrated with body 1 and/or tray 2 (such as when using molding techniques or 3D printing techniques to produce the case), or they may be distinct parts that are attached to body 1 or the respective tray 2 in other example embodiments as well. As indicated above, gasket 5 engages with an inside surface of lid 4 to seal contact lens solution within tray 4 via compression of gasket 5 between channel 15 and lid 4 when lid 4 is in the closed position.

Figure 6B:
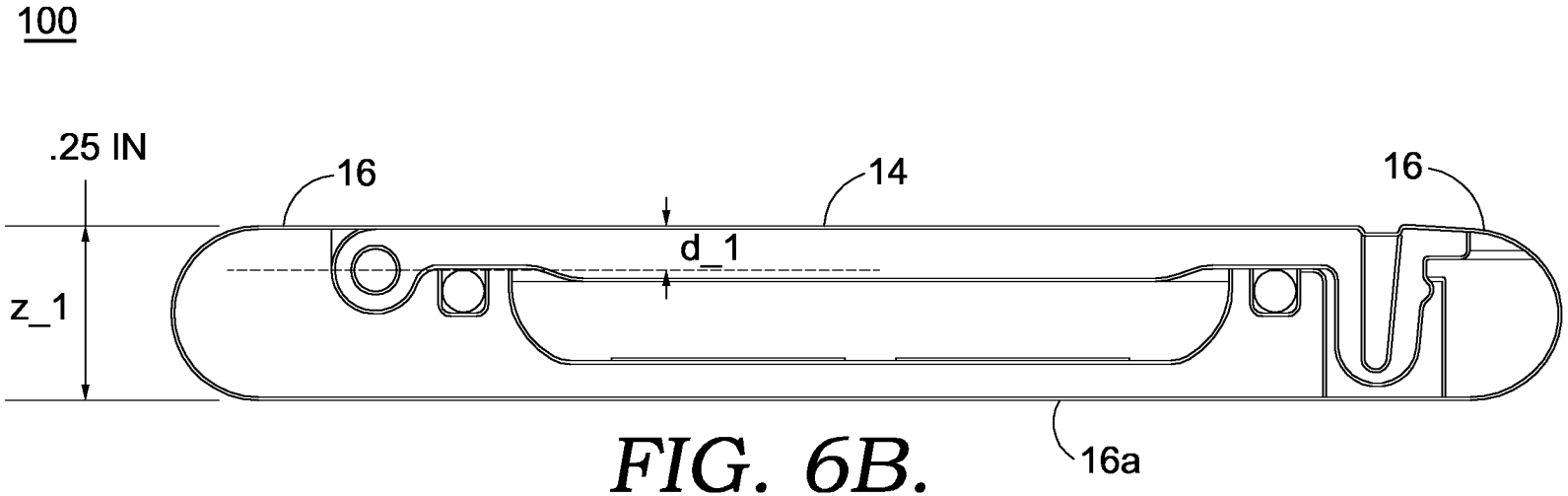

Each lid 4 may have a width that is substantially equal to the distance that the top edge of respective channel 15 2 is recessed within body 1. Further, each lid 4 may have a width that is substantially equal to a distance that the top edge of channel 15 is recessed within body 1, such that an upper surface 14 of each lid 4 lies flush with an upper surface 16 of body 1 when lid 4 is in the closed position, as best seen in FIGS. 5, 6A and 6B.

Since channel 15 and gasket 5 lie below upper surface 16 of body 1, the flush design of lids 4 with body 1 enables case 100 to have an overall thickness/depth (Z) between about 0.15 inches and about 0.35 inches, as shown in FIG. 6A. For example, an illustrative embodiment in FIG. 6B shows that the overall thickness/depth (z_1) of body 1 with lids 4 in the closed position is less than or equal to about 0.25 inches (e.g., a maximum of about ¼"), resulting in a uniquely slim and compact form factor that is significantly thinner in profile than other currently existing contact lens case designs. Further, upper surface of body 16 and a lower surface 16*a* may be parallel with one another, and overall shape of body 1 may be rectangular with rounded corners, for example, to further enhance the slim and compact form factor of case 100.

Figure 4:
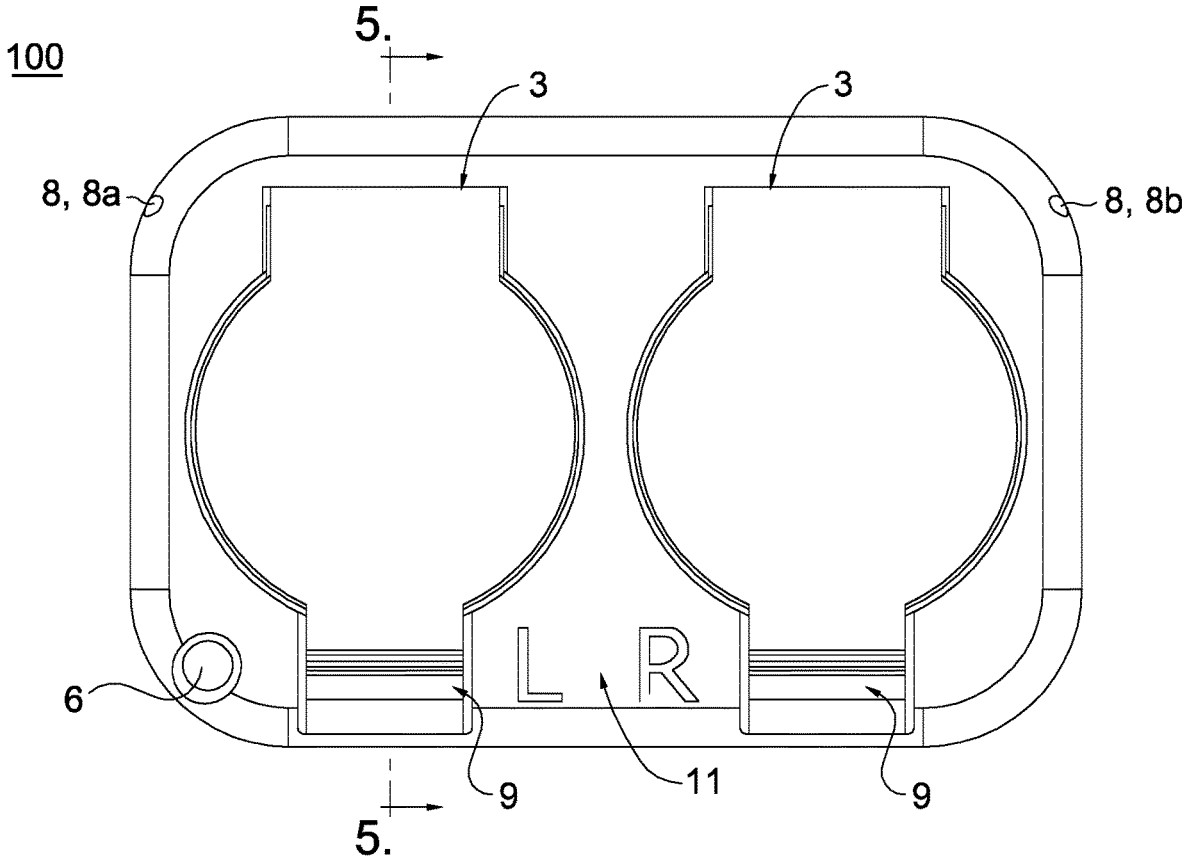
FIG. 4 is a top view of the contact lens case shown in FIG. 1 with both lens compartment covers in the closed position.

To allow the user to differentiate between left and right contact lenses, case 100 may provide indicia 11, such as "L" and "R" engravings 11, for example, on body 1 that are next to the respective left and right trays 2 (see FIGS. 3, 4 and 5). Indicia 11 may be placed in other locations as well, such as below trays 2 on body 1 (see FIG. 9) or on the corresponding lids 4 themselves. Additionally or alternatively, case 100 could have different colors for each lid 4, or other indicia 11 that would allow the user to easily distinguish between the left contact lens and the right contact lens.

Figure 7:
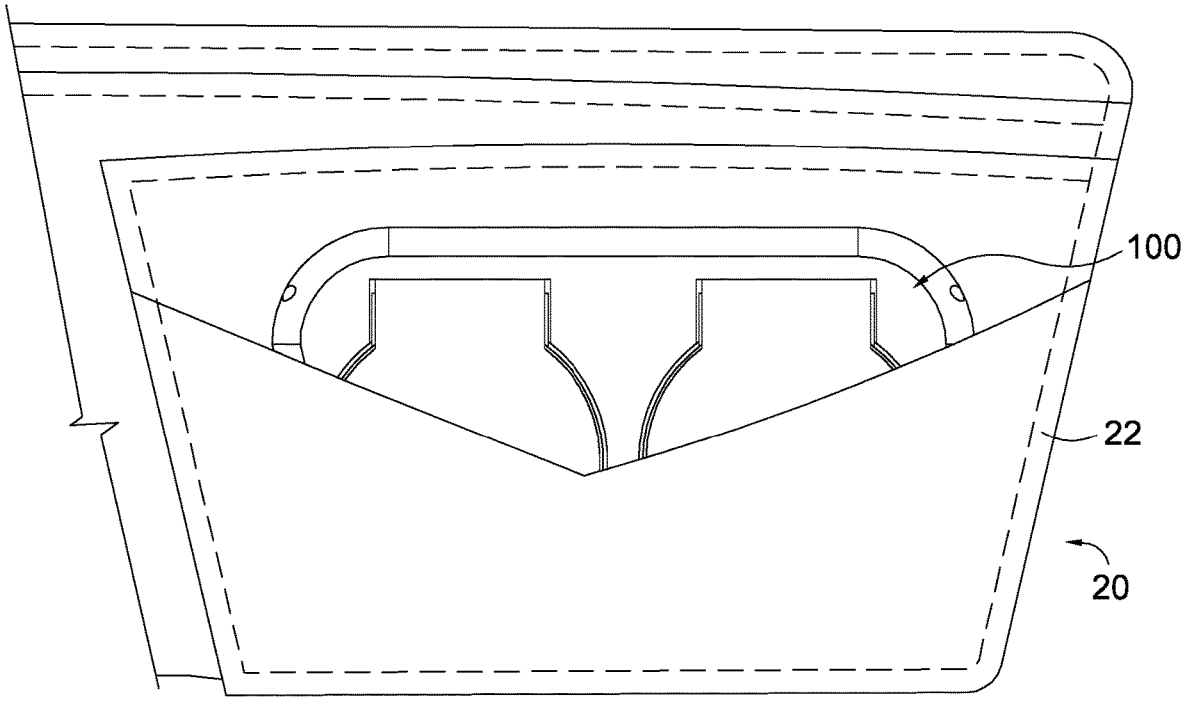
FIG. 7 is an isometric view showing the contact lens case shown in FIG. 1 being disposed within a carrying wallet.
Figure 8:
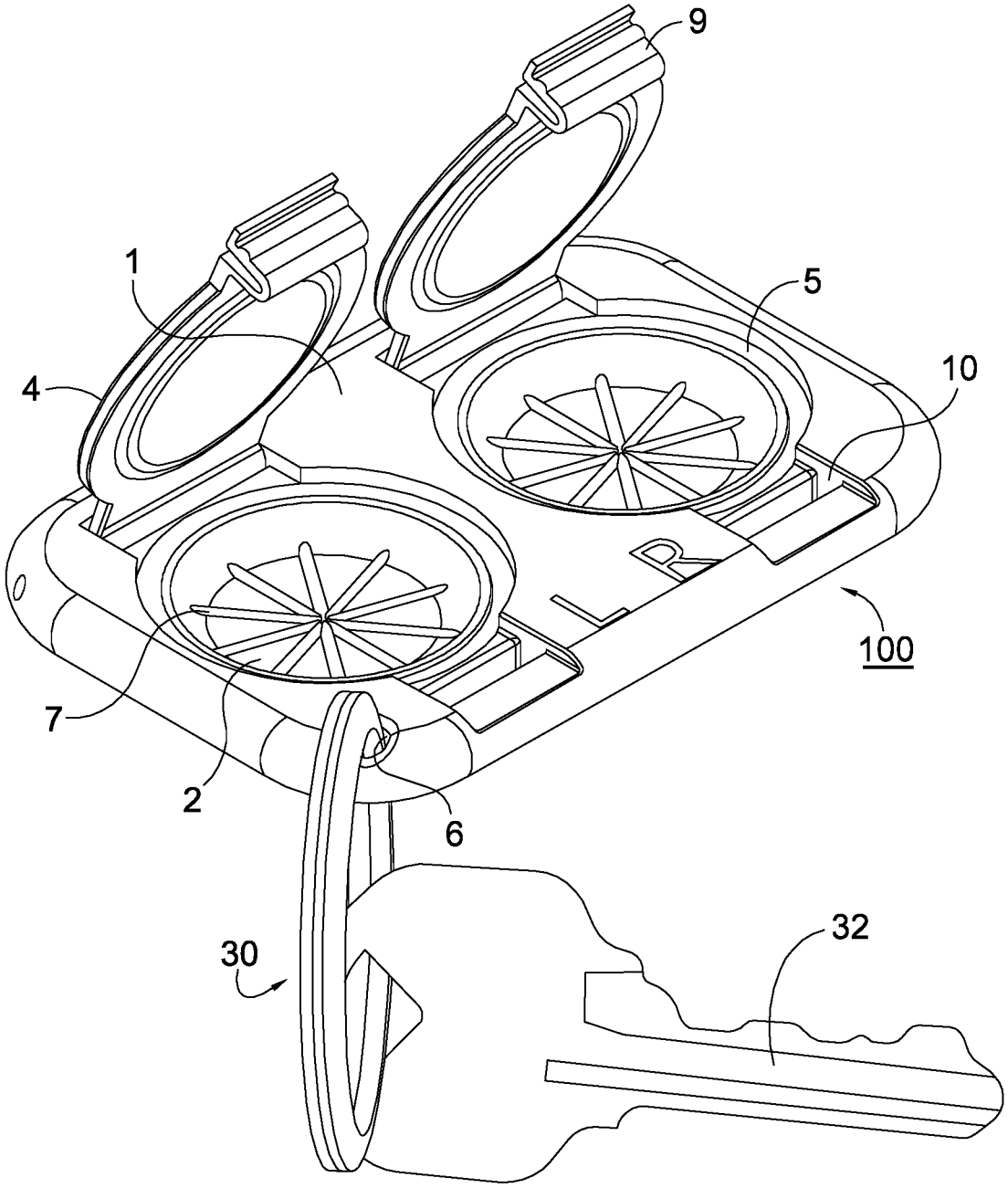
FIG. 8 is an isometric view showing a keychain coupled with the contact lens case shown in FIG. 1.

As shown in FIG. 7, slim contact lens case 100 preferably has a form factor that is thin and compact enough to fit into a slot 22 of a wallet 20. In some example embodiments, as shown in FIG. 8, a through-hole 6 may be defined near an outer edge of the body 1, such as one of the corners, which allows for case 100 to be attached to a keyring 30 so that contact lenses may conveniently be carried along with one or more key(s) 32.

In a practical use case of this example embodiment, the user will open each lid 4 and fill each of the left and right trays 2 with contact lens solution. The user will then place each contact lens into the pool of solution located within the respective tray 2 of each contact lens. Each tray 2 is designed to receive the contact lens in any orientation, whether the convex side of the contact lens is face down or face up within tray 2. After placement, the user will then close the respective lid 4 of each tray 2 to secure the lenses in trays 2 and seal the contact lens solution within body 1 of case 100. The thin and compact nature of slim contact lens case 100 will allow the user to effectively carry the case within a wallet, carrying bag, purse, pocket, luggage compartment, or any other storage compartment capable of containing the contact lens case.

Figure 9:
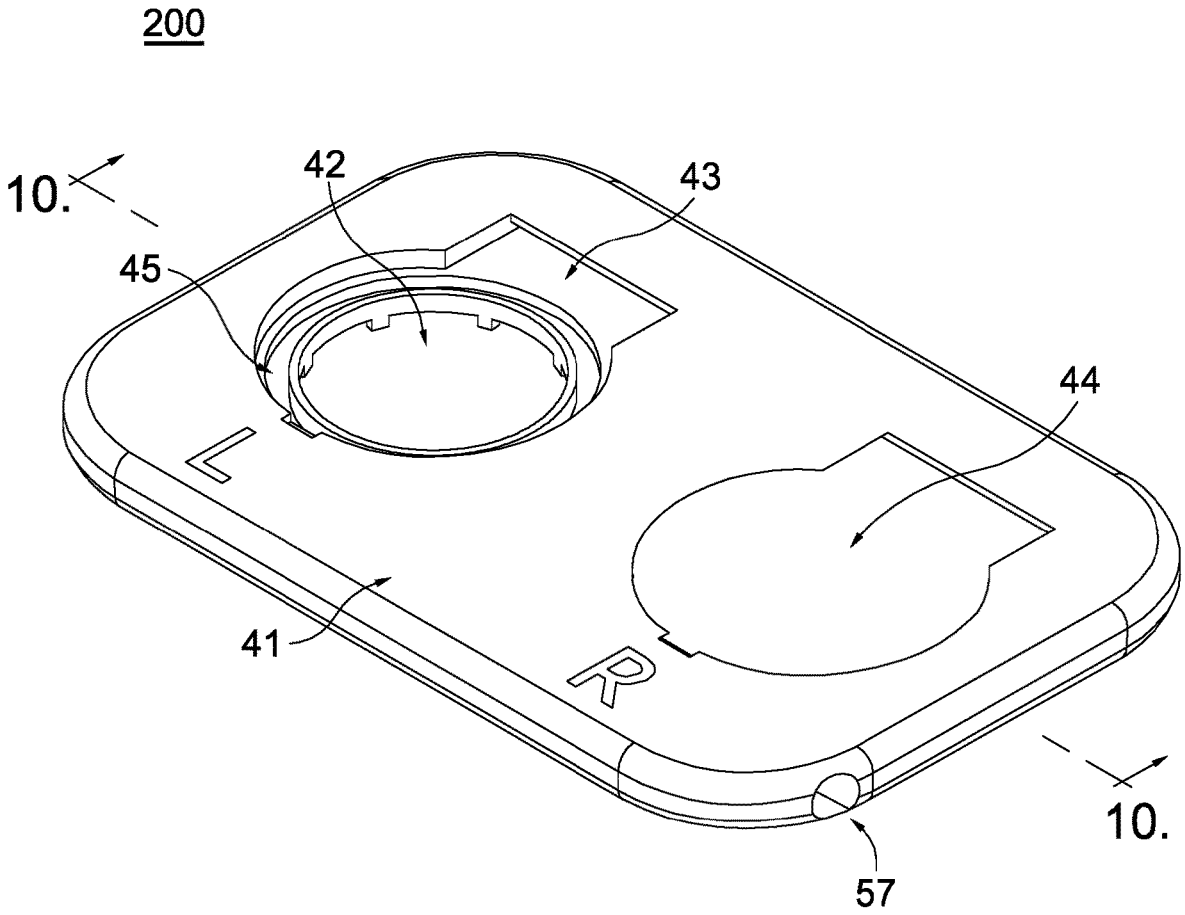
FIG. 9 shows an isometric view of another exemplary embodiment of a slim contact lens case including a drainage port, with the left lens compartment cover removed and the right lens compartment cover in the closed position.
Figure 10:
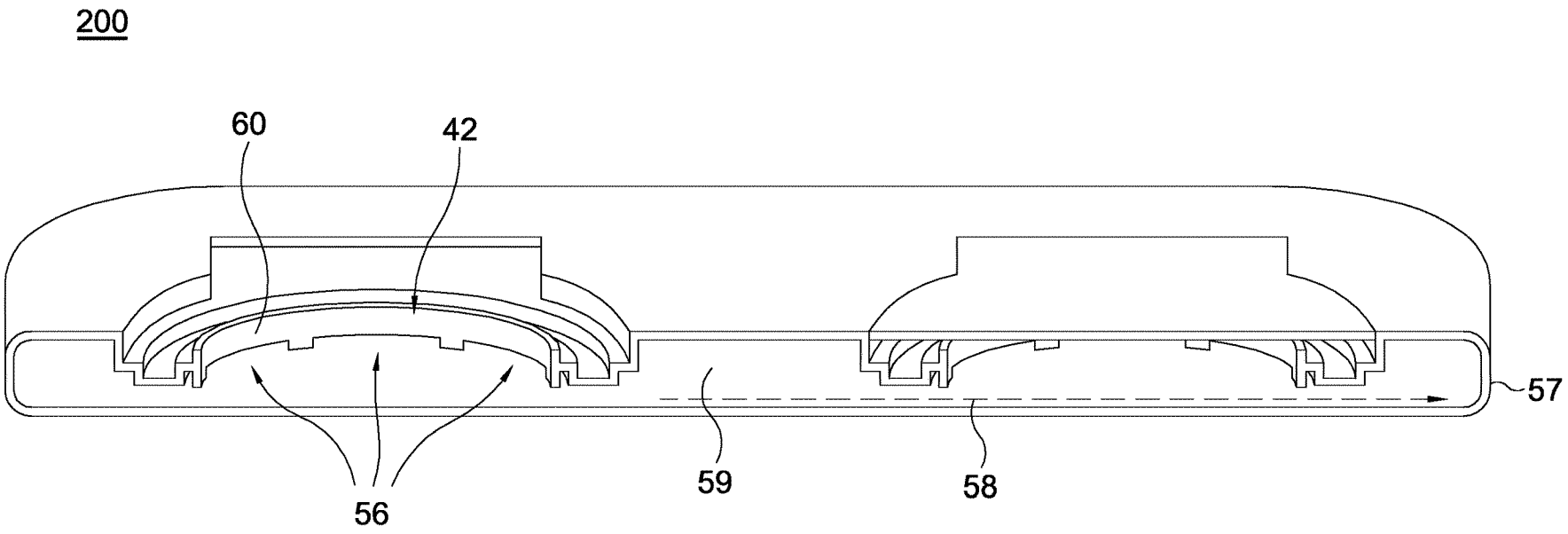
FIG. 10 shows a cross-sectional view taken along line 10-10 in FIG. 9 showing the drainage cavity defined in the contact lens case.

According to another aspect, an alternative example embodiment of a slim contact lens case 200 with a drainage port 57 is shown in FIGS. 9 and 10. The case 200 includes a body 41 having a relatively thin form factor that is at least partially hollow, with two individual compartments 42 for contact lens storage, and two respective lids 44 to protect and secure the contact lens within each tray 42. Each lid 44 is pivotally connected to body 41 by a means 43 (e.g., a hinge, a pin, or other attachment mechanism) which enables compartment lids 44 to be opened and closed, and/or optionally removed from body 41 according to some example embodiments. Each tray 42 contains a gasket 45 to seal tray 42 and prevent contact solution from leaking when lid 44 is in the closed position. Gaskets 45 are inserted into the left and right contact lens trays 42, respectively.

FIG. 9 shows an isomeric view of slim contact lens case 200 including a drainage port 57 with left lens compartment lid 44 removed and right lens compartment lid 44 in the closed position. FIG. 10 shows a perspective cross-sectional view of the front side of partially hollow bodied case 200 including a plurality of radial supports 5) and illustratively showing the draining cavity and path 58 beneath lens trays 42.

The partially hollow body 41 of case 200 can be filled with contact lens solution to clean and disinfect the inserted contact lenses, and can be easily drained via drainage port 57. FIG. 10 shows radial supports 56 found within each lens tray 42, which allow fluid flow while also containing the contact lens in tray 4. In particular, the supports 36 extend from a bottom wall 59 of tray 4 and extend upward to an upper ridge 60 of tray 4. The space defined between supports 56 allows contact lens solution contained within tray 4 to flow between upper and lower walls of body 1 (i.e., within body 1), and even into the other tray 4 generally along a path indicated by dotted arrow 58. When the user wishes to drain the contact lens solution from the case 200, contact lens solution can be released through drainage port 57. Drainage port 57 may have a sliding cover, plug, or other mechanism (not shown) to close port 57 and prevent the contact lens solution from unintentionally leaking out from body 41 through drainage port 57.

A practical use case of this alternative example embodiment of case 200 is similar to the example described above for case 100, except the user may fill either one of the left or right tray 42 with contact solution, as the fluid will disperse throughout body 41 of case 200 (due to its partially hollow nature, in combination with the function provided by radial supports 56 of trays 42). Further, the user will also need to ensure that drainage port 57 is closed when filling body 41 with contact solution and closing compartment lids 44 to secure the contact lenses in their respective trays 42 and seal the contact lens solution within body 41 of case 200.

Turning now to FIGS. 11-14, another exemplary embodiment of a slim contact lens case 300 generally includes a body 310 defining respective left and right recessed wells **312*l* and 312*r* within body 310. In general, body 310 can be made from a variety of materials, including plastics, rubbers, silicone, polymers, metals, or any other material(s) commonly used in the contact lens case industry. Body 310 may be formed as a generally rectangular prism having a top face 310*a*, bottom face 310*b* and sidewall 310*c* having a thickness dimension $d_1$. In one aspect of the present invention, dimension $d_1$ is selected to be less than about 0.5 inches, and more preferably between 0.25 inches and 0.375 inches. As shown in FIGS. 11-14, sidewall 310*c* may have a tapered or curved outer edge 310' and rounded corners 310"** for increased user comfort and/or design aesthetics.

Each recessed well **312*l*, 312*r* may be defined by a respective sidewall 3141, 314*r* having a thickness dimension $d_2$, where $d_2$ is less than $d_1$ such that a respective bottom wall 316*l*, 316*r* is formed within body 310. One or more radially extending protrusions 318 may project upwardly from a bottom wall 316*l*, 316*r* into recessed well 312*l*, 312*r*. Protrusions 318 may prevent a contact lens from sticking to bottom wall 316*l*, 316*r*, while also allowing contact lens fluid to be positioned between the contact lens and bottom wall 316*l*, 316*r*. It will be understood that, during use, each recessed well 312*l*, 312*r* may be filled with contact lens solution to clean and disinfect a contact lens stored within its respective recessed well 312*l*, 312*r***.

Figure 11:
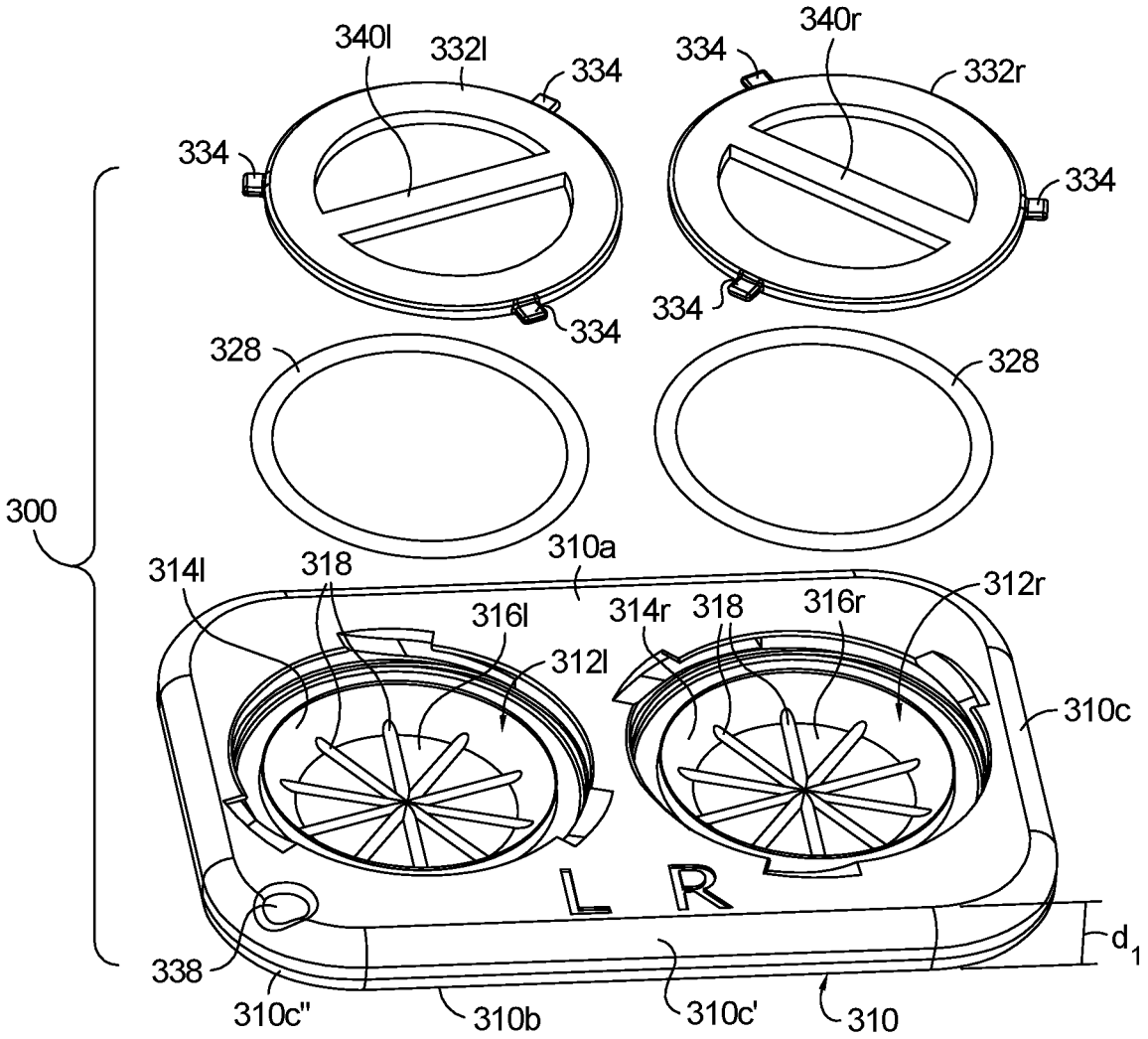
FIG. 11 is an exploded view of another example embodiment of a slim contact lens case in accordance with the present invention.
Figure 11A:
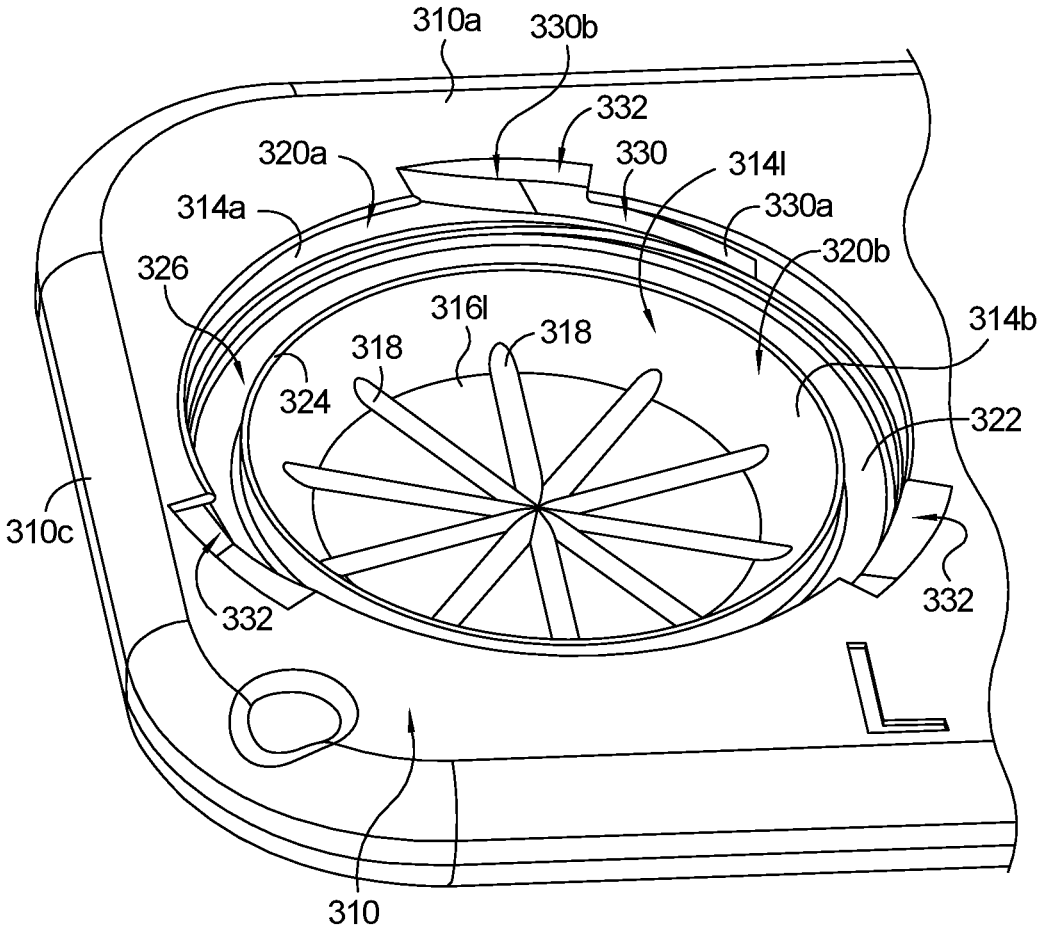
FIG. 11A is an expanded view of a recessed well of the example embodiment shown in FIG. 11.

With reference to FIG. 11A, sidewall 3141 (sidewall 3141 is shown, but the below discussion applies equally to sidewall **314*r*) may be delineated into upper sidewall portion 314*a* defining an upper recess portion 320*a* and lower sidewall portion 314*b* defining a lower recess portion 320*b* by ledge 322 such that upper sidewall portion 314*a* has a larger diameter than lower sidewall portion 314*b*. Lower sidewall portion 314*b* may include a lip portion 324 extending upwardly at the junction with ledge 320 into upper recess portion 320*a* so as to define a channel 326 between upper sidewall portion 314*a*, lip portion 324 and ledge 322**.

Figure 12:
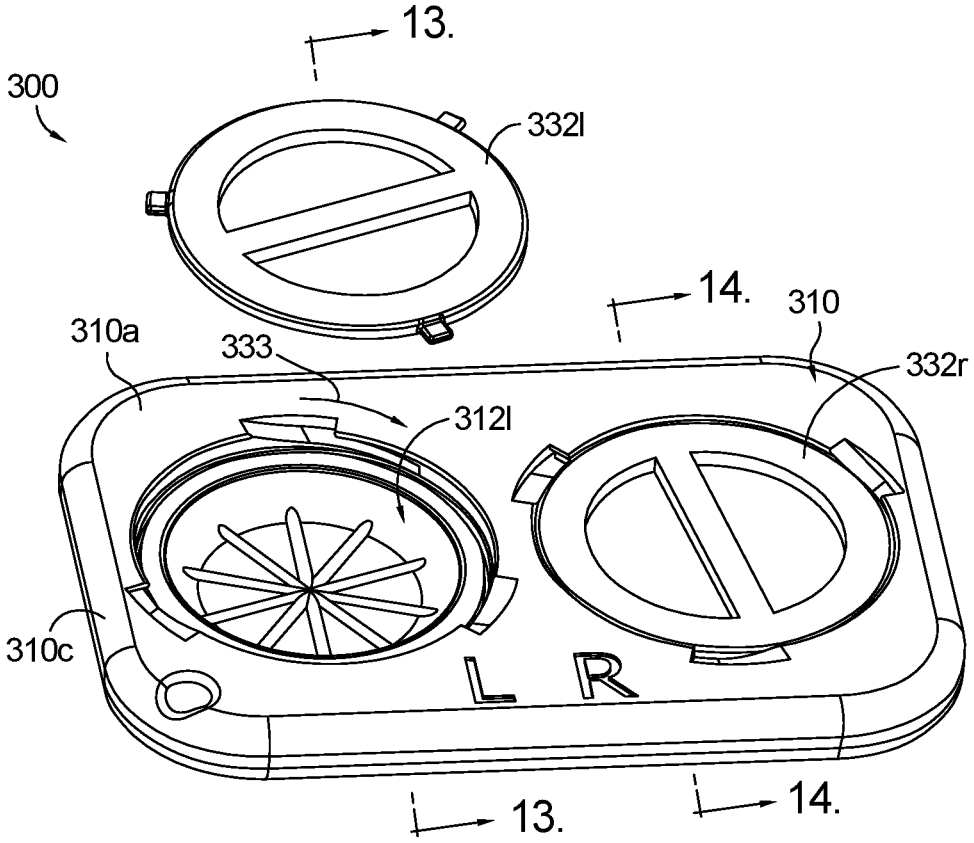
FIG. 12 is an isometric view of the example embodiment shown in FIG. 11 with the left lens cap/plug removed and the right lens cap/plug secured to the case body.
Figure 13:
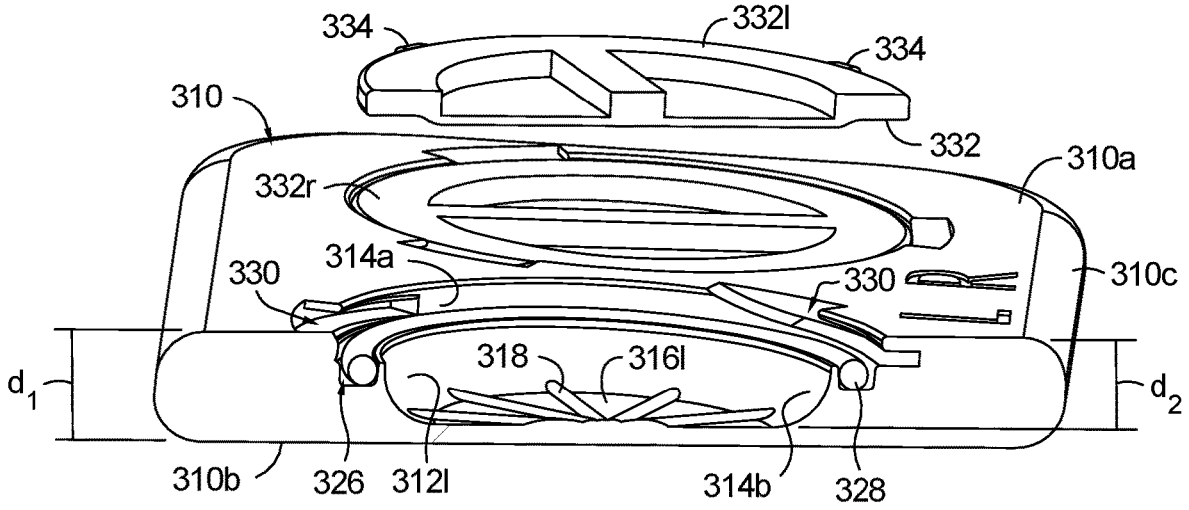
FIG. 13 is a cross-sectional view taken along line 13-13 in FIG. 12 showing the left recessed well and cap/plug.
Figure 14:
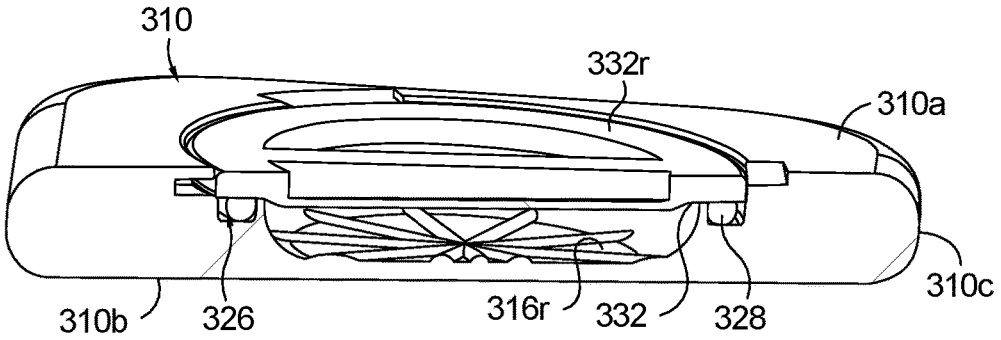
FIG. 14 is a cross-sectional view taken along line 14-14 in FIG. 12 showing the right recessed well and cap/plug.

As seen in FIGS. 12-14, channel 326 may be configured to receive a gasket or O-ring 328 therein for sealing recessed well **312*l*, as will be described in greater detail below. Returning to FIG. 11A, body 310 may define one or more inclined slots 330 within upper sidewall portion 314*a*. Each slot 330 includes a first end 330*a* which terminates within body 310 and a second end 330*b* which terminates at top face 310*a* so as to define an opening 332 within top face 310*a***.

As shown in FIGS. 11 and 12, each recessed well **312*l*, 312*r* may be selectively closed by a respective cap or plug 332*l*, 332*r* in order to protect and retain each contact lens within its respective recessed well 312*l*, 312*r* and/or prevent contact lens solution from leaking out of recessed well 312*l*, 312*r*. With additional reference to FIG. 11, each cap/plug 332*l*, 332*r* may be removably coupled to body 310 through engagement of one or more tabs 334 on cap/plug 332*l*, 332*r* within a corresponding respective slot 330 defined within upper sidewall portion 314*a***.

Opening 326 is dimensioned so as to easily receive a tab 322 therein whereby cap/plug **332*l*, 332*r* may be rotated such that each tab 334 slidably engages its respective slot 330. To aid the user, top surface 332*a* cap/plug 332*l*, 332*r* may include a grip bar 340*l*, 340*r* which is adapted to be gripped by the user's thumb and finger to rotate cap/plug 332*l*, 332*r*. When placing recessed well 312*l*, 312*r* in a closed orientation, each cap/plug 332*l*, 332*r* is rotated, such as in a clockwise direction as generally indicated by arrow 333, until tab 334 is snuggly received within second end 330*b* of slot 330 so as to enable closure of recessed well 312*l*, 312*r*** as will be described in greater detail below.

As shown in FIG. 14, cap/plug **332*l*, 332*r* has been rotated to snuggly place tab 334 within second end 330*b* of slot 330 while gasket/O-ring 328 is disposed in channel 326. The location and dimension of each slot 330 and each tab 334 is selected such that when properly engaged with one another to place recessed well 312***l*, 312*r* in the closed orientation, inner surface 332*b* of cap/plug 332 sealingly contacts, and more preferably slightly compresses, gasket/O-ring 328 so as to prevent the contact lens solution from flowing out of recessed well 312*l*, 312*r*. Each gasket/O-ring 328 may be formed of one or more materials such as, but not limited to, plastics, rubbers, silicone, neoprene, polyurethane, polymers or other suitable materials for providing a tight seal under compression.

As further shown in FIG. 14 cap/plug 332*l*, 332*r* is dimensioned to have a thickness whereby top surface 332*a* of cap/plug 332 sits flush relative or slightly below the plane defined by top face 310*a* of body 310 to provide a slim profile as set forth in the present invention.

To allow the user to differentiate between left and right contact lenses, body 310 may include indicia 336, such as but not limited to an engraved letters "L" for "left" and "R" for "right", near their respective recessed well 312*l*, 312*r* (see FIGS. 11 and 12) and/or on the corresponding cap/plug 332*l*, 332*r* itself. Additionally or alternatively, lens case 300 may include different colors for each recessed well 312*l*, 312*r* and/or cap/plug 332*l*, 332*r* to differentiate each recessed well 312*l*, 312*r*.

In some example embodiments, such as those shown in FIGS. 11, 11A and 12, body 310 may further include a through-hole 338 defined near its outer edge 310*c*' or corner 310*c*" to allow lens case 300 to be attached to a keyring as described above with regard to lens case 100.

From the above, it should be noted that lens case 300 includes a body 310 and associated caps/plugs 332 that possess a relatively thin and compact form factor in comparison to standard contact lens cases. In one aspect, the thickness of lens case 300 is selected to be less that about 0.5 inches, and more preferably between about 0.25 inches and about 0.375 inches. This thin and compact nature of slim contact lens case 300 may thus allow the user to effectively and conveniently carry the case within a wallet, carrying bag, purse, pocket, luggage compartment, or any other storage compartment capable of receiving the contact lens case.

Figure 15:
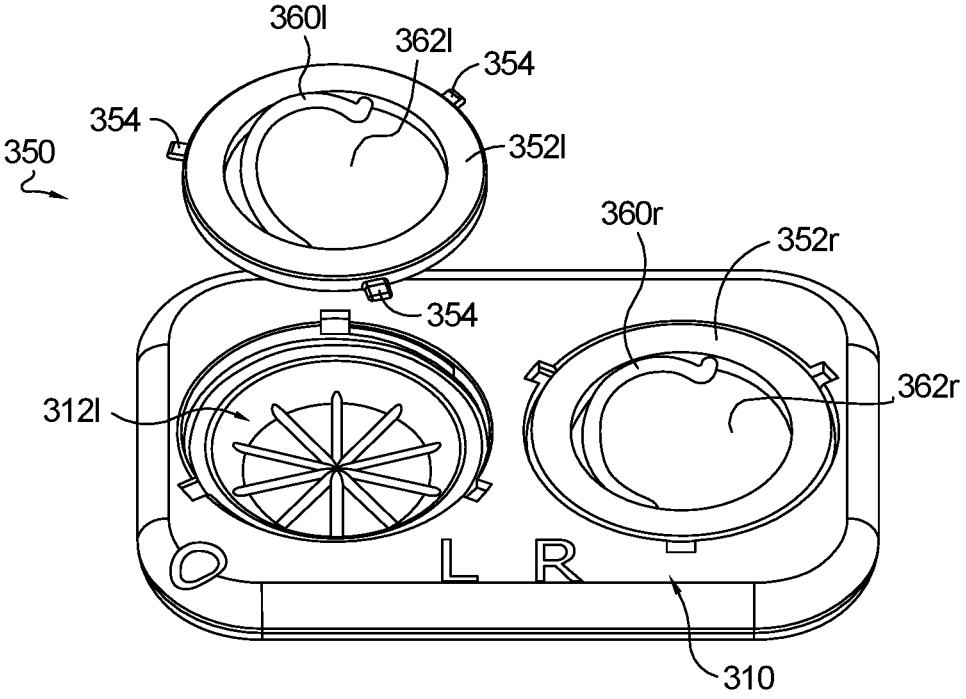
FIG. 15 is an isometric view of a further example embodiment of a slim contact lens case in accordance with the present invention.
Figure 16:
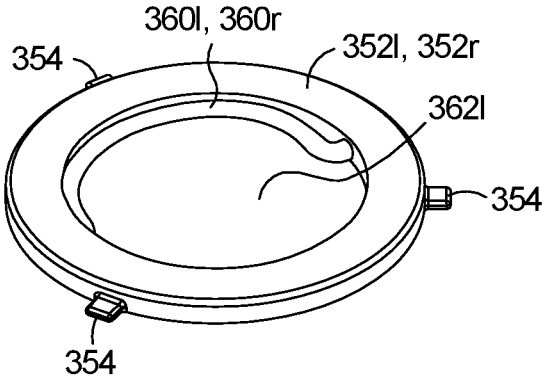
FIG. 16 is an isolated view of a cap/plug configured for use with the example embodiment shown in FIG. 15 with the handle in the stowed position.
Figure 17:
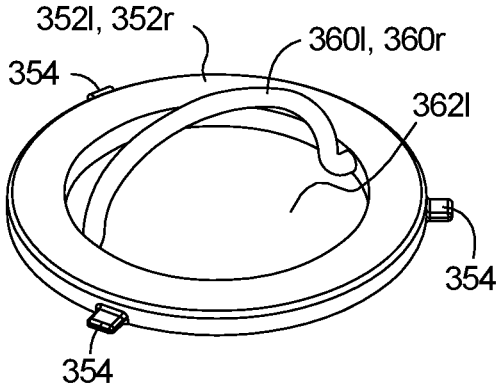
FIG. 17 is an isolated view of the cap/plug shown in FIG. 16 with the handle in the grasping position.

Turning now to FIGS. 15-17, a further embodiment of a contact lens case 350 is shown. Contact lens case 350 includes a case body 310 that is identical to body 310 described above with regard to case 300 (see FIGS. 11-14), including left and right recessed wells 312*l*, 312*r*. Case 350 differs only in the cap/plug 352*l*, 352*r* in relation to cap/plug 332*l*, 332*r*. Similar to cap/plug 332*l*, 332*r*, cap/plug 352*l*, 352*r* includes one or more tabs 354 which are configured to be matingly received within a respective slot 330 defined within body 310.

However, whereas cap/plug 332*l*, 332*r* includes a grip bar 340*l*, 340*r* to assist a user in rotating cap/plug 332*l*, 332*r* during use, cap/plug 352*l*, 352*r* includes a handle 360*l*, 360*r* for easy grasping. Each handle 360*l*, 360*r* may be pivotally secured within a respective recess 3621, 362*r* defined in a top surface of cap/plug 352*l*, 352*r*. Each handle 360*l*, 360*r* may thus be pivoted to extend generally perpendicularly to the plane defined by cap/plug 352*l*, 352*r* when the user is opening or closing lens case 350 (FIG. 17) while also being pivoting to be received within recess 3621, 362*r* to maintain a flush surface of case 350 when carrying case 350 within a wallet, pocket, bag, etc., as described above From the foregoing, it will be seen that this invention is one well adapted to attain all the ends and objects hereinabove set forth together with other advantages which are obvious and which are inherent to the method and apparatus. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. As used herein, the terms "having" and/or "including" and other terms of inclusion are terms indicative of inclusion rather than requirement.

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed is:

1. A contact lens case comprising:

a body including a first upper surface, a bottom surface and a sidewall therebetween, wherein the body defines a first recessed well configured to receive a first contact lens therein and a second recessed well configured to receive a second contact lens therein;

a first cap removably coupled with the body to selectively cover the first recessed well when in a closed position, wherein the first cap includes a second upper surface, the second upper surface being flat, and wherein the first upper surface of the body is flush with the entire second upper surface of the first cap when the first cap is in the closed position; and a second cap removably coupled with the body to selectively cover the second recessed well when in a closed position, wherein the second cap includes a third upper surface, the third upper surface being flat, and wherein the first upper surface of the body is flush with the entire third upper surface of the second cap when the second cap is in the closed position, wherein the first upper surface, second upper surface, and third upper surface define an uppermost surface of the contact lens case.

2. The contact lens case according to claim 1, wherein the body includes a first channel and a second channel defined therein, wherein the first channel and second channel are configured to receive a first and second gasket, respectively, and wherein the first and second gaskets are positioned to engage the respective first and second caps when the first and second caps are in their respective closed positions.

3. The contact lens case according to claim 2, wherein the first and second caps each have a width substantially equal to a distance that each of the first and second channels are recessed within the body.

4. The contact lens case according to claim 1, wherein a length of the sidewall of the body is between about 0.15 inches and about 0.5 inches.

5. The contact lens case according to claim 4, wherein the distance between the first upper surface and the lower surface is less than or equal to ¼ inch.

6. The contact lens case according to claim 1, wherein the first upper surface of the body is parallel to the bottom surface of the body.

7. The contact lens case according to claim 1, wherein the first and second recessed wells include a plurality of radially extending protrusions projecting from a bottom wall thereof.

8. The contact lens case according to claim 1, wherein each respective cap includes one or more tabs adapted to selectively engage with a corresponding slot defined in the body to secure the respective cap in the closed position.

9. The contact lens case according to claim 1, further comprising an indicia for distinguishing the first recessed well from the second recessed well.

10. The contact lens case according to claim 1, wherein the body has a through-hole defined therein for receiving a keyring therethrough.

11. The contact lens case according to claim 1, wherein each respective cap includes a grip bar defined thereon.

12. The contact lens case according to claim 1, wherein each respective cap includes a handle pivotally mounted thereon.

13. A contact lens case comprising:

a body including a first flat upper surface and a bottom surface, wherein the body defines a first recessed well configured to receive a first contact lens therein and a second recessed well configured to receive a second contact lens therein;

a first cap coupled with the body to selectively cover the first recessed well when covering the first recessed well, wherein the first cap includes a second flat upper surface, and wherein the first flat upper surface is flush with the entire second flat upper surface of the first cap when the first cap covers the first recessed well;

a second cap coupled with the body to selectively cover the second recessed well covering the second recessed well, wherein the second cap includes a third flat upper surface, and wherein the first flat upper surface of the body is flush with the entire third flat upper surface of the second cap when the second cap covers the second recessed well, wherein the first upper surface, second upper surface, and third upper surface define an uppermost surface of the contact lens case;

a first closure having a cap component integral to the first cap and a body component within the body, wherein the first closure secures the first cap to the body to cover the first recessed well;

a second closure having a cap component integral to the second cap and a body component within the body, wherein the second closure secures the second cap to the body to cover the second recessed well; wherein the first closure and second closure are between the first flat upper surface and the bottom surface when the first cap and second cap cover the first recessed well and the second recessed well, respectively; and a first hinge and a second hinge coupled to the first cap and second cap, respectively, wherein the first and second hinges couple the first cap and second cap to the body, respectively, and wherein the first and second hinges are between the first flat upper surface and the bottom surface.

* * * * *